US008282782B2

(12) United States Patent
Sawada et al.

(10) Patent No.: US 8,282,782 B2
(45) Date of Patent: Oct. 9, 2012

(54) WET PAPER WEB TRANSFER BELT

(75) Inventors: Takeshi Sawada, Tokyo (JP); Kenji Inoue, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 425 days.

(21) Appl. No.: 12/530,550

(22) PCT Filed: Jan. 31, 2008

(86) PCT No.: PCT/JP2008/051586

§ 371 (c)(1),
(2), (4) Date: Sep. 9, 2009

(87) PCT Pub. No.: WO2008/111338

PCT Pub. Date: Sep. 18, 2008

(65) Prior Publication Data

US 2010/0101744 A1 Apr. 29, 2010

(30) Foreign Application Priority Data

Mar. 13, 2007 (JP) ..... 2007-063218

(51) Int. Cl.
*D21F 7/08* (2006.01)

(52) U.S. Cl. ..... 162/306; 162/358.2; 162/358.4; 162/900; 162/901

(58) Field of Classification Search ..... 162/306, 162/358.1, 358.2, 358.4, 900–903; 442/76, 442/218, 220, 226, 227, 242, 243, 271, 274, 442/275, 277, 281, 118
See application file for complete search history.

(56) References Cited

U.S. PATENT DOCUMENTS 4,425,392 A * 1/1984 Oikawa et al. ..... 428/90
(Continued)

FOREIGN PATENT DOCUMENTS

EP 480 868 A1 4/1992
(Continued)

OTHER PUBLICATIONS

International Search Report for International Application No. PCT/JP2008/051586 dated Feb. 20, 2008.

*Primary Examiner* — Eric Hug
(74) *Attorney, Agent, or Firm* — Kratz, Quintos & Hanson, LLP

(57) ABSTRACT

A wet paper web transfer belt (1) has a wet paper web-side layer (31) including a resin and a hydrophilic fibrous body (30) and a machine-side layer (32). A basic fabric (33) disposed in the belt comprises a first woven fabric (34) disposed on a wet paper web (W) side and a second woven fabric (35) disposed on a press roll (10) side. The first woven fabric (34) and the second woven fabric (35) are stacked together. At least a portion of the hydrophilic fibrous body (30) is exposed on a surface (37) of the wet paper web-side layer (31). The basis weight of the first woven fabric (34) is greater than the basis weight of the second woven fabric (35). The structure is effective to improve a first function to cause the wet paper web (W) to stick thereon and to transfer the wet paper web (W), and a second function to allow the wet paper web (W) to be smoothly released from the belt for transferring the wet paper web (W) to a next process. The belt (1) has opposite edges (E) prevented from being curled while the belt (1) is traveling.

17 Claims, 8 Drawing Sheets

U.S. PATENT DOCUMENTS

| | | | | |
|---|---|---|---|---|
| 4,461,803 | A * | 7/1984 | Booth et al. | 442/206 |
| 4,503,113 | A * | 3/1985 | Smart | 442/199 |
| 5,056,565 | A * | 10/1991 | Kufferath | 139/383 A |
| 6,358,369 | B1 * | 3/2002 | Yoshida et al. | 162/358.2 |
| 6,989,080 | B2 * | 1/2006 | Hansen | 162/375 |
| 2002/0137416 | A1 | 9/2002 | Hagfors | |
| 2004/0185729 | A1 * | 9/2004 | Inoue | 442/118 |

FOREIGN PATENT DOCUMENTS

| | | | |
|---|---|---|---|
| JP | 2-277847 | | 11/1990 |
| JP | 4-185788 | | 7/1992 |
| JP | 2000-110090 | | 4/2000 |
| JP | 2004-277971 | A1 | 10/2004 |
| JP | 2005-146448 | A1 | 6/2005 |

* cited by examiner

WET PAPER WEB TRANSFER BELT

TECHNICAL FIELD

The present invention relates to a wet paper web transfer belt for transferring a wet paper web at a high speed in a closed-draw-type papermaking machine.

BACKGROUND ART

Papermaking machines for dewatering the paper material include a wire part, a press part and a drier part. The wire part, the press part and the drier part are arranged in the order named along the direction in which the wet paper web is transferred.

Some papermaking machines are of the type which transfers the wet paper web in open draws. The open-draw papermaking machines do not support the wet paper web with belts. As a result, the wet paper web tends to be broken in a region in which it is transferred from one section to another. Accordingly, the open-draw papermaking machines are difficult to operate at higher speeds.

In recent years, papermaking machines which are of the type for transferring the wet paper web in closed draws are prevalent in the art. The closed-draw papermaking machines have a belt for transferring the wet paper web. The wet paper web is placed on the belt and is transferred by the belt from one section to another. As a result, the closed-draw papermaking machines can operate at higher speeds and more stably.

In the closed-draw papermaking machines, the wet paper web is transferred by being transferred successively through the wire part, the press part and the drier part. In the press part, the wet paper web is transferred by the transfer belt, and is pressed by a press device to squeeze water out. Thereafter, the wet paper web is dried in the drier part.

The present applicant has proposed, in Japanese published patent application No. 2004-277971, a wet paper web transfer belt which has a first function to cause the wet paper web to stick thereon and to transfer the wet paper web and a second function to allow the wet paper web to be smoothly released from the belt for transferring the wet paper web to a next process. The wet paper web transfer belt includes a wet paper web-side layer comprising a high-polymer elastic region and a fibrous body. The fibrous body is hydrophilic and is partly exposed on the surface of the wet paper web-side layer.

As the hydrophilic fibrous body which is exposed on the surface of the wet paper web-side layer retains the water from the wet paper web, the belt performs the first function to cause the wet paper web to stick on the belt and to transfer the wet paper web. The portion of the fibrous body which is exposed on the surface of the wet paper web-side layer, so that the belt performs the second function to allow the wet paper web to be smoothly released from the belt for transferring the wet paper web to the next process.

Normally, the wet paper web transfer belt has a width which is substantially identical to the width of the press region and guide rollers. When the wet paper web transfer belt moves around the press region and the guide rollers of the papermaking machine, the wet paper web transfer belt tends to have its opposite edges, i.e., left and right edges spaced transversely across the traveling direction of the belt, and nearby portions curled between the press region and the guide rollers and also between the guide rollers themselves.

The curling of the wet paper web transfer belt is also referred to a "bimetal phenomenon" similar to the bimetal effect. The opposite edges and nearby portions of the belt are downwardly or upwardly curled. When the wet paper web transfer belt is curled, it is difficult for the wet paper web transfer belt to travel at a high speed in the papermaking machine.

The present applicant has proposed a papermaking belt which minimizes the curling of its opposite edges in Japanese published patent application No. 2000-110090.

Patent document 1: Japanese published patent application No. 2004-277971

Patent document 2: Japanese published patent application No. 2000-110090

The wet paper web transfer belt disclosed in Japanese published patent application No. 2004-277971 has both of the above two functions balanced. However, the disclosed wet paper web transfer belt does not include anything to reduce the curling of the opposite edges and nearby portions of the belt while the wet paper web transfer belt is traveling.

When part of the water contained in the wet paper web is absorbed by the hydrophilic fibrous body (e.g., rayon fibers) of the wet paper web-side layer, the fibrous body expands and then makes the wet paper web transfer belt dimensionally unstable. In recent years, particularly, since the wet paper web transfer belt is required to travel at increased speeds, it is necessary to reduce an increase in the widthwise dimension of the belt which is caused by the absorption of water by the hydrophilic fibrous body.

The papermaking belt disclosed in Japanese published patent application No. 2000-110090 has a tendency to curl in the direction of a resin layer thereof. The disclosed papermaking belt is arranged to make its opposite ends resistant to curling by having the opposite edges of the resin layer thinner than the central area of the resin layer.

However, Japanese published patent application No. 2000-110090 fails to disclose any technical solutions for achieving the above two functions for the papermaking belt, and also for bringing the center of gravity of a base fabric closely toward the wet paper web.

The present invention has been made to solve the above problems. It is an object of the present invention to provide a wet paper web transfer belt for improving a first function to cause a wet paper web to stick on the belt and to transfer the wet paper web, and a second function to allow the wet paper web to be smoothly released from the belt for transferring the wet paper web to a next process, and for reducing curling of the opposite edges and nearby portions of the wet paper web transfer belt while the wet paper web transfer belt is traveling.

DISCLOSURE OF THE INVENTION

The wet paper web-side layer of the wet paper web transfer belt comprises a resin layer containing a resin such as a high-polymer elastic material. Therefore, as described in Japanese published patent application No. 2000-110090, the opposite ends of the wet paper web transfer belt has a property (tendency) to curl in a direction away from the wet paper web (shoe) whether the belt is traveling or not.

While the wet paper web transfer belt is traveling, a tension is applied to the wet paper web transfer belt to pull the wet paper web transfer belt in the direction in which it is traveling. Most of the tension acts on the base fabric which makes the belt strong. The center of the tension which is applied to the base fabric is essentially aligned with the center of gravity of the base fabric.

The inventors of the present invention have focused attention on the fact that while the wet paper web transfer belt is traveling, the opposite edges and nearby portions of the wet paper web transfer belt are curled due to the relationship between the tension applied to the base fabric of the wet paper web transfer belt while it is traveling and the center of gravity of the base fabric on which the tension acts.

Specifically, the inventors conducted an experiment which used a wet paper web transfer belt wherein the vertical position of the center of gravity of the base fabric is close to the wet paper web, i.e., spaced from the press roll. The experiment indicated that since the center of the tension which is applied to the base fabric of the wet paper web transfer belt while it is traveling is shifted toward the wet paper web, the opposite edges and nearby portions of the wet paper web transfer belt are curled toward the wet paper web.

When the wet paper web transfer belt travels, its innate tendency to curl the opposite edges thereof in a direction away from the wet paper web and the action of the wet paper web transfer belt to curl the opposite edges and nearby portions thereof in a direction toward the wet paper web offset (cancel) each other. As a consequence, any curling of the opposite edges and nearby portions of the wet paper web transfer belt is minimized while the wet paper web transfer belt is traveling.

In particular, if the base fabric is of a laminated structure comprising a plurality of superposed woven fabrics, then an upper one of the woven fabrics which is disposed near the wet paper web comprises a woven fabric having a large basis weight and a lower one of the woven fabrics which is disposed near the press roll comprises a woven fabric having a small basis weight.

The base fabric made up of those woven fabrics has its center of gravity positioned in the upper woven fabric, i.e., closely to the wet paper web. Accordingly, the wet paper web transfer belt including the base fabric thus constructed has its opposite sides and nearby portions essentially free of curling while the wet paper web transfer belt is traveling.

To achieve the above object, there is provided in accordance with the present invention a wet paper web transfer belt for transferring a wet paper web in a closed-draw papermaking machine. The wet paper web transfer belt has a wet paper web-side layer including a resin and a hydrophilic fibrous body and disposed on a wet paper web side and a machine-side layer disposed on a press roll side, and a base fabric is disposed in the belt.

The base fabric comprises a first woven fabric disposed to the wet paper web side and a second woven fabric disposed to the press roll side, and the first woven fabric and the second woven fabric are stacked together. At least a portion of the hydrophilic fibrous body is exposed on a surface of the wet paper web-side layer, and the basis weight of the first woven fabric is greater than the basis weight of the second woven fabric.

Preferably, either one or both of the first woven fabric and the second woven fabric include weft yarns made of a material of low water absorptivity. The weft yarns of the woven fabrics are preferably made of a material selected from the group consisting of polyester, aromatic polyamide, aromatic polyester and polyether ketone.

According to a preferred example, the first woven fabric may be of a double weave and the second woven fabric may be of a plain weave. According to another example, the first woven fabric may be of a triple weave and the second woven fabric may be of a double weave. According to still another example, the first woven fabric may be of a triple weave and the second woven fabric may be of a plain weave.

Preferably, the hydrophilic fibrous body is formed in the wet paper web-side layer of the belt by needle punching to improve a first function, to cause the wet paper web to stick thereon and to transfer the wet paper web, and a second function to allow the wet paper web to be smoothly released therefrom for transferring the wet paper web to a next process.

Preferably, the resin in the wet paper web-side layer comprises a high-polymer elastic material, and the high-polymer elastic material is made of a thermosetting resin selected from the group consisting of urethane, epoxy and acrylic, or of a thermoplastic resin selected from the group consisting of polyamide, polyarylate and polyester, and the wet paper web-side layer comprises a resin layer including the high-polymer elastic material.

Preferably, the vertical position of the center of gravity of the base fabric itself is shifted to the first woven fabric closely to the wet paper web. The dimension from the position of the center of gravity of the base fabric to an upper surface of the first woven fabric is smaller than the dimension from the position of the center of gravity to a lower surface of the second woven fabric.

Preferably, an innate property thereof to curl opposite edges of the belt in a direction away from the wet paper web and an action thereof to curl the opposite edges of the belt in a direction toward the wet paper web under tension cancel each other when the belt travels.

For example, the wet paper web-side layer comprises a wet paper web-side batt layer and the machine-side layer comprises a machine-side batt layer, and each of the wet paper web-side batt layer and the machine-side batt layer is made of staple fibers. The hydrophilic fibrous body is used as the staple fibers of the wet paper web-side batt layer, and fibers having lower official moisture regain than the hydrophilic fibrous body are used as the staple fibers of the machine-side batt layer.

Preferably, the hydrophilic fibrous body of the wet paper web-side layer is made of fibers selected from the group consisting of hydrophilic fibers of nylon, vinylon, acetate, rayon, polynosic rayon, cuprammonium rayon, cotton, hemp, silk and wool for sufficiently performing the first function to cause the wet paper web to stick on the wet paper web transfer belt and to transfer the wet paper web.

The hydrophilic fibrous body is made of fibers having surfaces which are preferably processed by a hydrophilic process selected from the group consisting of a mercerizing process, a resinating process, a sputtering process based on the application of an ionizing radiation, and a glow discharge process.

Preferably, the hydrophilic process is performed on the surfaces of the fibers of the hydrophilic fibrous body at a contact angle of 30 degrees or less with water while the moisture of hydrophilic monofilaments or twist yarns is adjusted to a value in the range from 30 to 50%.

For example, the machine-side batt layer is made chiefly of nylon fibers for contact with the press roll, and the machine-side batt layer comprises a fibrous body made of fibers which are less hydrophilic than the hydrophilic fibrous body of the wet paper web-side batt layer, and whose official moisture regain is different from the official moisture regain of the hydrophilic fibrous body by 4% or more.

Preferably, the fibrous body of the machine-side batt layer is made of fibers selected from the group consisting of fibers of vinylidene, polyvinyl chloride, polyethylene, polypropylene, polyester, aromatic polyamide, polyurethane and acrylic.

Preferably, the wet paper web-side batt layer of the wet paper web-side layer has a basis weight set to a value ranging from 50 to 600 g/m$^2$, and the machine-side batt layer (40) of the machine-side layer has a basis weight set to a value ranging from 0 to 600 g/m$^2$.

The wet paper web transfer belt thus constructed according to the present invention is capable of improving a first function to cause the wet paper web to stick thereon and transfer the wet paper web and a second function to allow the wet paper web to be smoothly released therefrom for transferring the wet paper web to a next process. The wet paper web transfer belt is also able to reduce curling of opposite edges and nearby portions thereof while the wet paper web transfer belt is traveling.

BRIEF DESCRIPTION OF THE DRAWINGS

FIG. 1 is a schematic view of a closed-draw papermaking machine which employs a wet paper web transfer belt according to the present invention;

FIG. 2 is a schematic perspective view of a portion of the closed-draw papermaking machine;

FIG. 3 is a schematic cross-sectional view of a shoe press mechanism of the closed-draw papermaking machine;

FIG. 4 is a cross-sectional view of a wet paper web transfer belt according to a first embodiment of the present invention;

FIG. 5 is a cross-sectional view of a wet paper web transfer belt according to a second embodiment of the present invention;

FIG. 6 is a cross-sectional view of a wet paper web transfer belt according to a third embodiment of the present invention;

FIG. 7 is a plan view of the wet paper web transfer belts; and

FIG. 8 is a schematic view of an experimental apparatus for evaluating the performance of wet paper web transfer belts.

BEST MODE FOR CARRYING OUT THE INVENTION

Wet paper web transfer belts according to the present invention will be described below.

Figure 1:
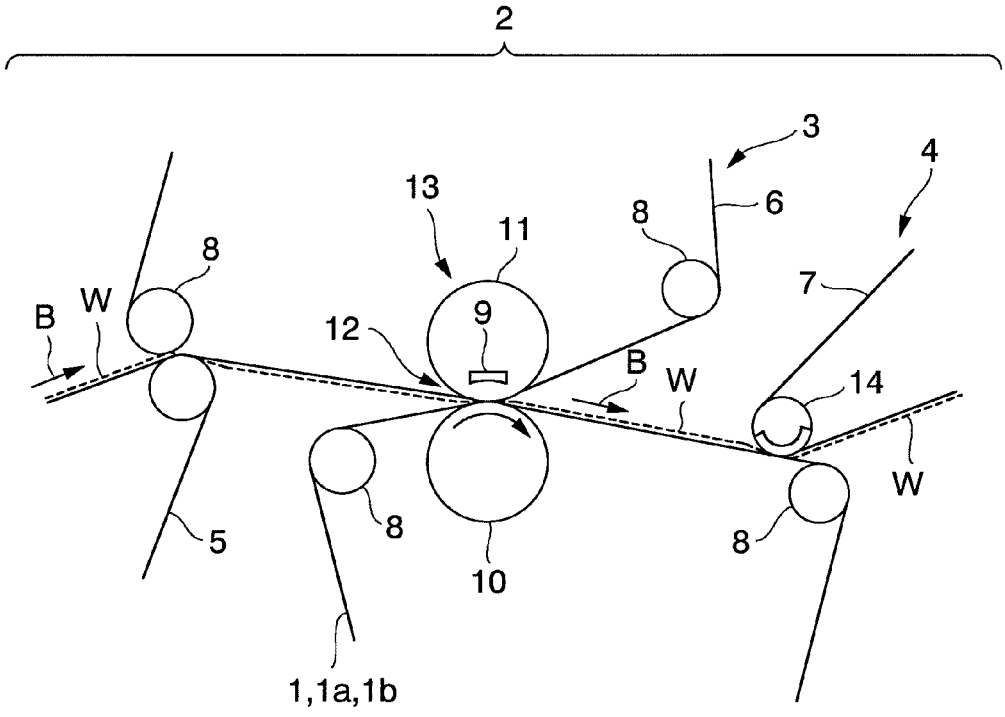
FIGS. 1 through 8 are views which are illustrative of the present invention.
Figure 2:
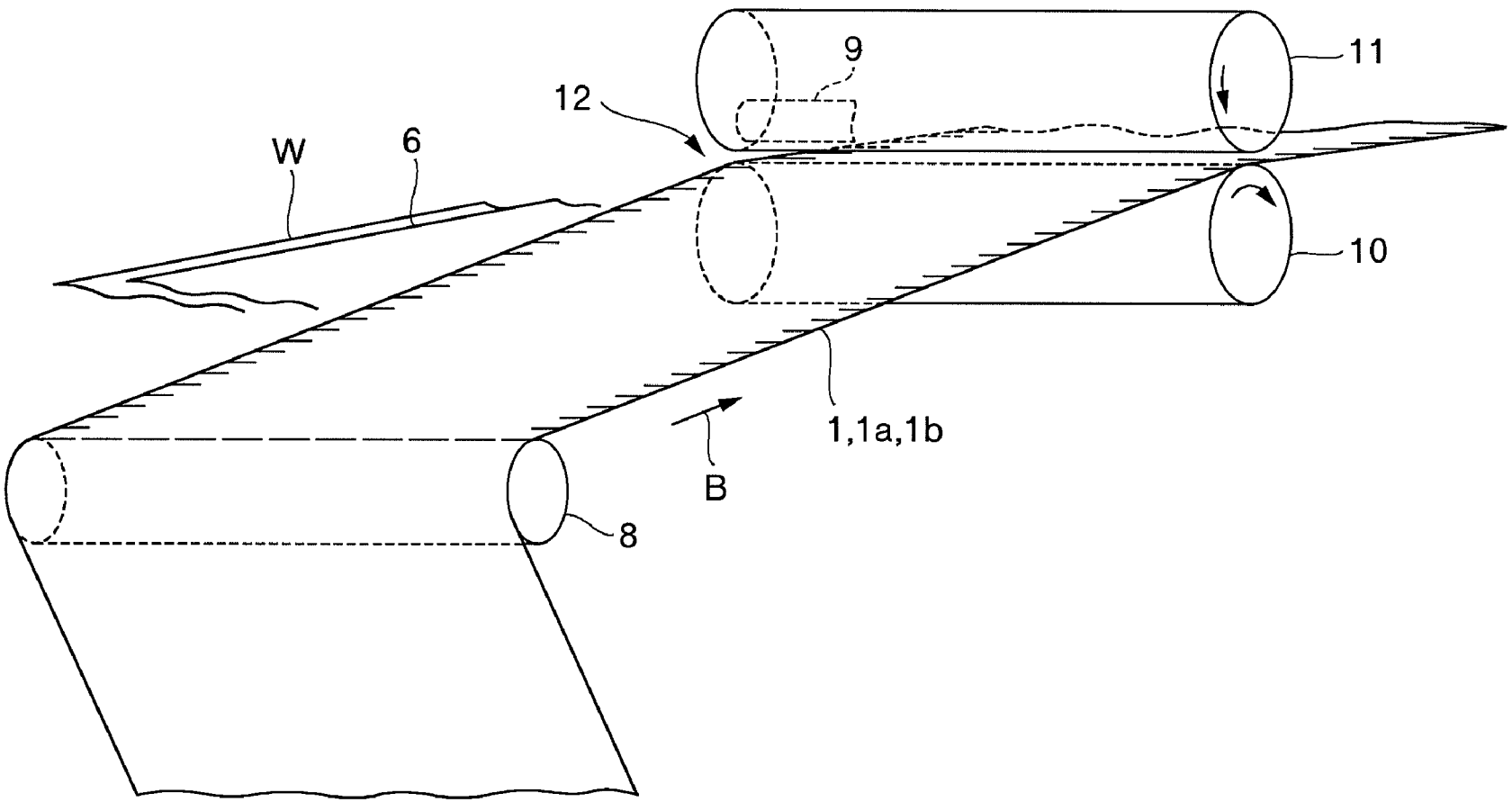
Figure 3:
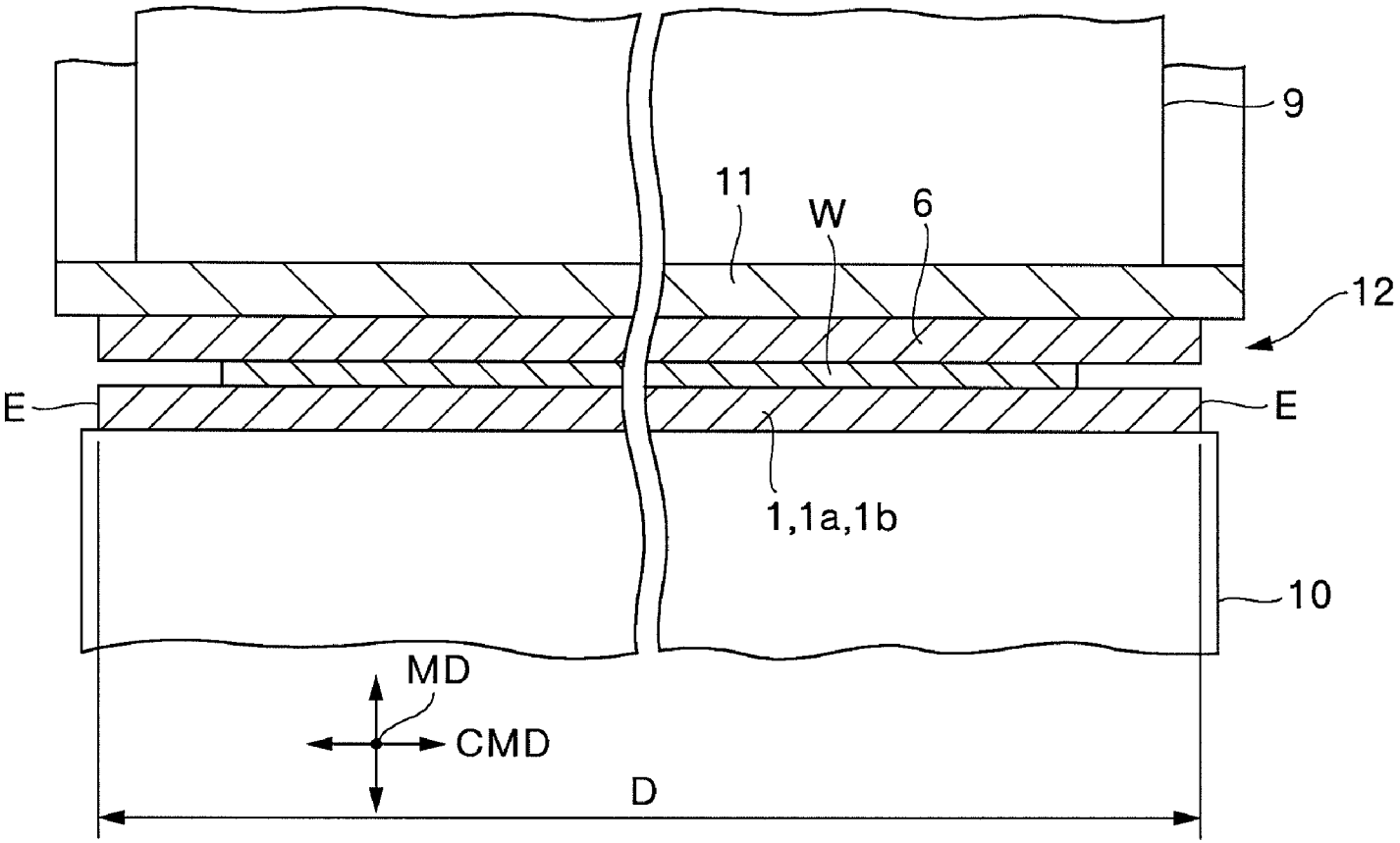

FIGS. 1 through 8 are views which are illustrative of the present invention. FIG. 1 is a schematic view of a closed-draw papermaking machine which employs a wet paper web transfer belt according to the present invention. FIG. 2 is a schematic perspective view of a portion of the closed-draw papermaking machine. FIG. 3 is a schematic cross-sectional view of a shoe press mechanism of the closed-draw papermaking machine.

As shown in FIGS. 1 through 3, a closed-draw papermaking machine (hereinafter referred to as "papermaking machine") 2 for dewatering the paper material comprises a wire part (not shown), a press part 3 and a drier part 4. The wire part, the press part 3 and the drier part 4 are arranged in the order named along the direction in which a wet paper web W is transferred (the direction indicated by the arrow B).

The wet paper web W is transferred by being moved successively through the wire part, the press part 3 and the drier part 4. After water is squeezed out of the wet paper web W in the press part 3, the wet paper web W is finally dried in the drier part 4. A wet paper web transfer belt 1 (hereinafter referred to as "belt 1") is disposed in the press part 3 and is used to transfer the wet paper web W in the direction indicated by the arrow B.

The wet paper web W is supported by press felts 5, 6, the belt 1 and a drier fabric 7, and is transferred in the direction indicated by the arrow B. Each of the press felts 5 and 6, the belt 1 and the drier fabric 7 is in the form of an endless strip which is supported by guide rollers 8.

A shoe 9 is of a concave shape complementary to a press roll 10. The shoe 9 and the press roll 10 with a shoe press belt 11 interposed therebetween make up a press region 12.

A shoe press mechanism 13 has the press roll 10 and the shoe 9 which is disposed upwardly (or downwardly) of the press roll 10. The shoe press belt 11 is disposed between the press roll 10 and the shoe 9 and travels while in rotation. A plurality of shoe press mechanisms 13 are disposed in a linear array along the direction in which the wet paper web W is transferred (the direction indicated by the arrow B), thereby providing the press part 3 of the papermaking machine 2.

After the wet paper web W is transferred from the wire part (not shown) to the press part 3, it is transferred from the press felt 5 to the press felt 6. The wet paper web W is then transferred to the press region 12 of the shoe press mechanism 13 by the press felt 6.

In the press region 12, the wet paper web W, as it is held between the press felt 6 and the belt 1, is pressed by the shoe 9 and the press roll 10 with the shoe press belt 11 interposed therebetween. As a result, water in the wet paper web W is squeezed out.

The press felt 6 is highly permeable to water, and the belt 1 is of low water permeability. Therefore, water in the wet paper web W moves to the press felt 6 in the press region 12. In this manner, the wet paper web W is dewatered and has its surface smoothed in the press part 3.

Immediately after the wet paper web W leaves the press region 12, the wet paper web W, the press felt 6 and the belt 1 have their volumes expanded because they are quickly released from the pressure. Due to their expansion and the capillary action of the pulp fibers of the wet paper web W, a so-called "rewetting phenomenon" occurs in which part of the water in the press felt 6 moves to the wet paper web W.

Since the belt 1 is of low water permeability, it retains little water therein. Therefore, any rewetting phenomenon in which water moves from the belt 1 to the wet paper web W does not essentially take place. The belt 1 thus contributes to an increase in the smoothness of the wet paper web W.

The wet paper web W which has passed through the press region 12 is transferred by the belt 1 in the direction indicated by the arrow B. Then, the wet paper web W is attracted by a suction roll 14 and is transferred by the drier fabric 7 to the drier part 4 in which the wet paper web W is dried.

The belt 1 is required to have a first function to positively cause the wet paper web W to stick on the surface of the belt 1 immediately after the wet paper web W leaves the press region 12. The belt 1 is also required to have a second function to release the wet paper web W smoothly from the belt 1 when the belt 1 transfers the wet paper web W to the next process (the drier part 4).

The belt 1 will be described below.

Figure 4:
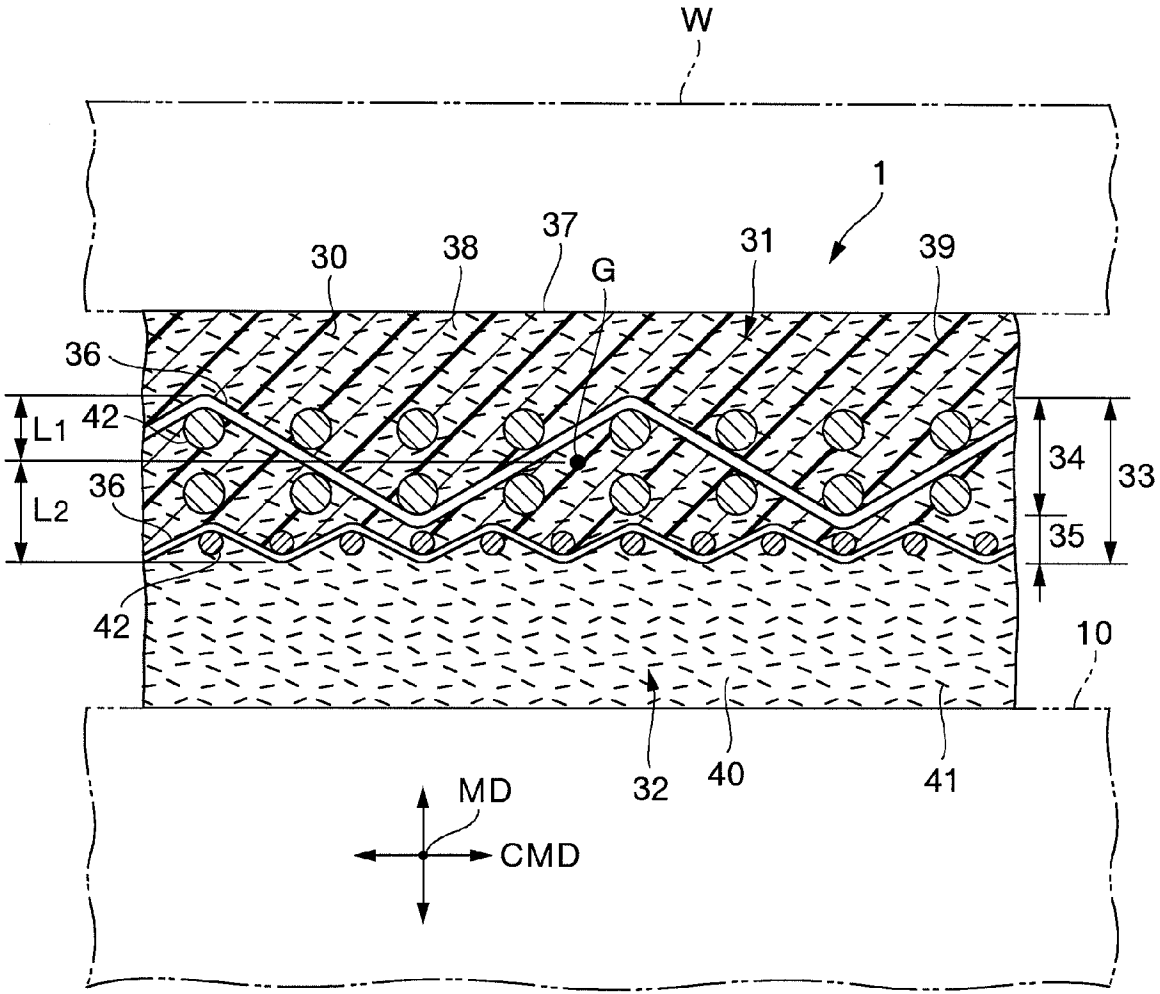
Figure 5:
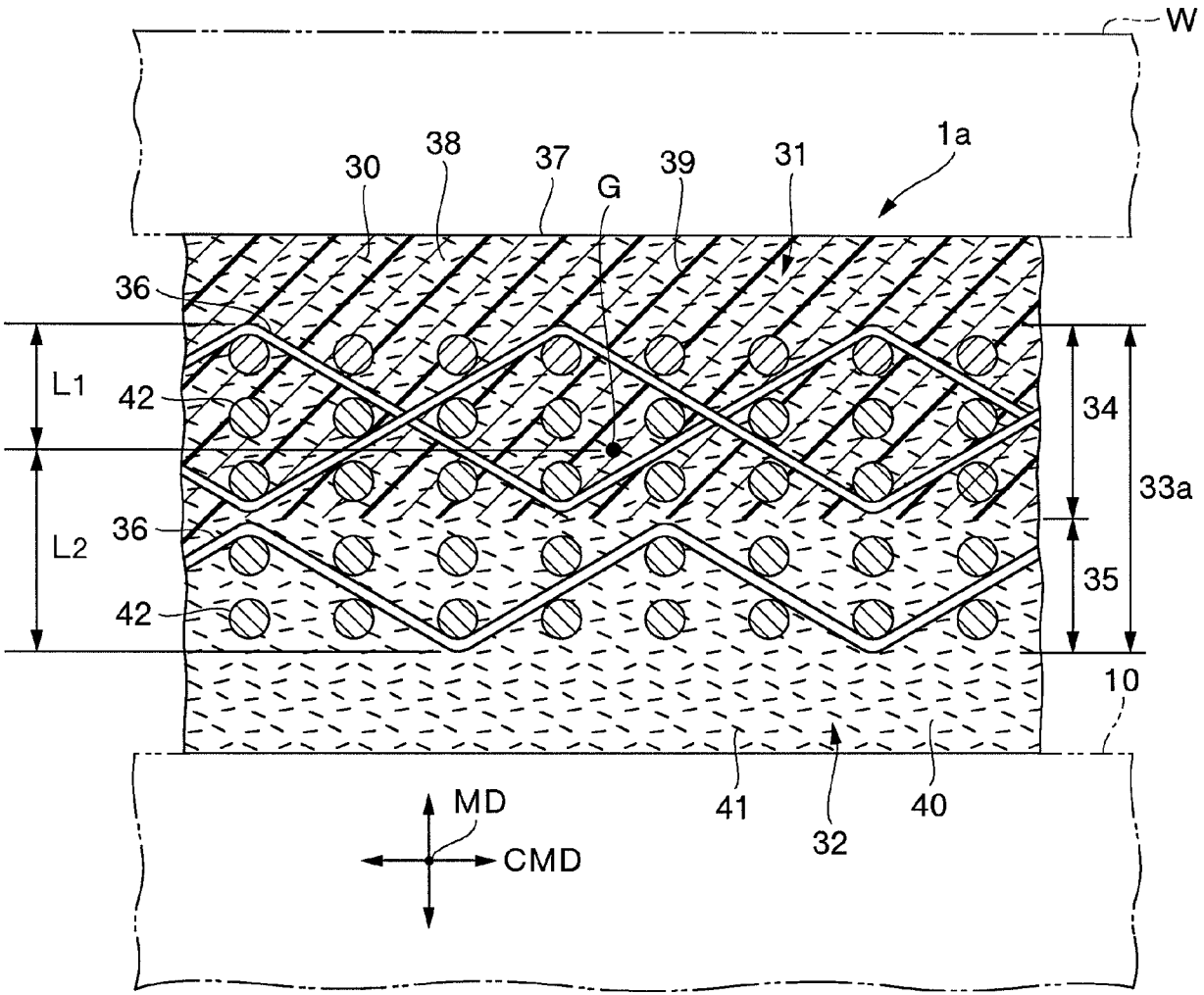
Figure 6:
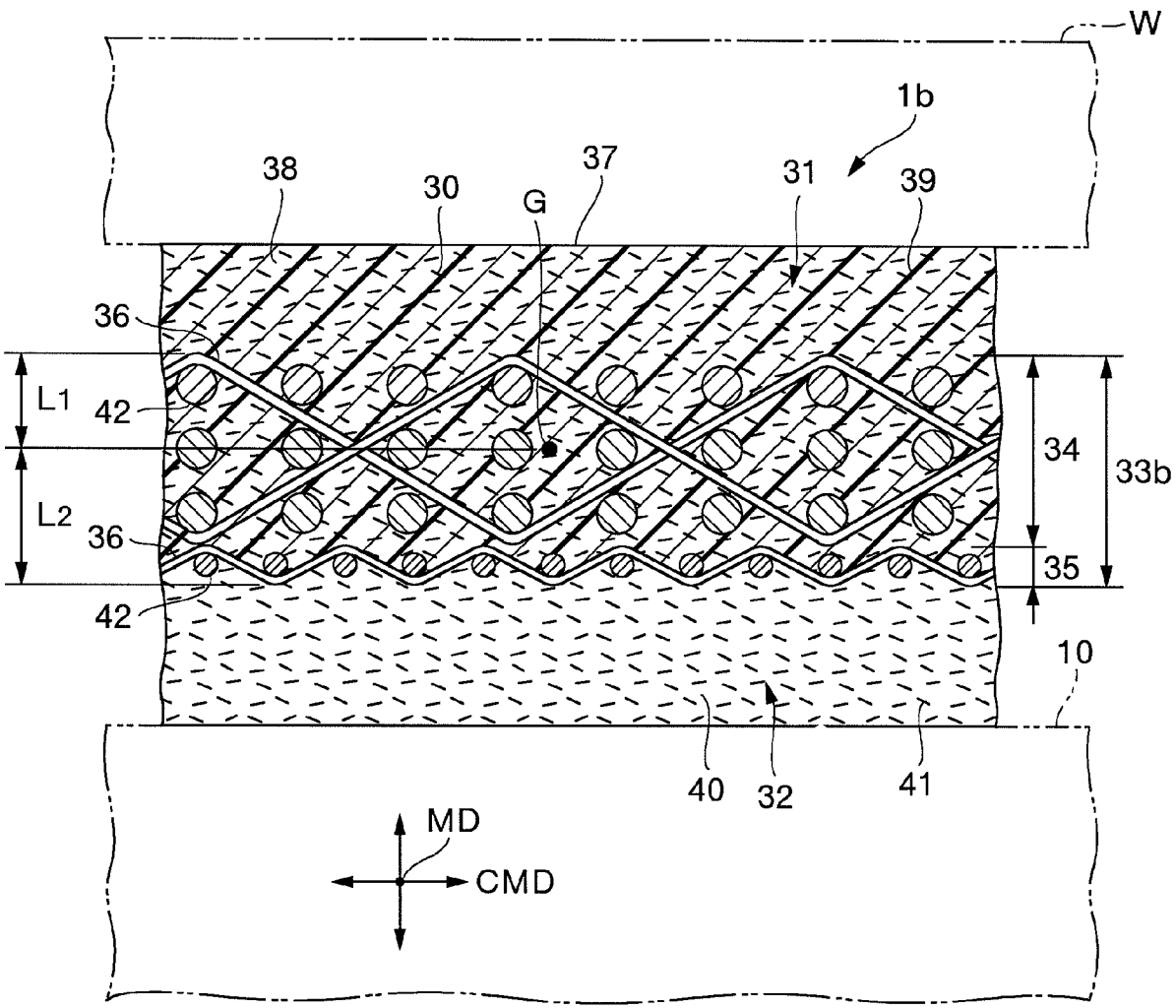
Figure 7:
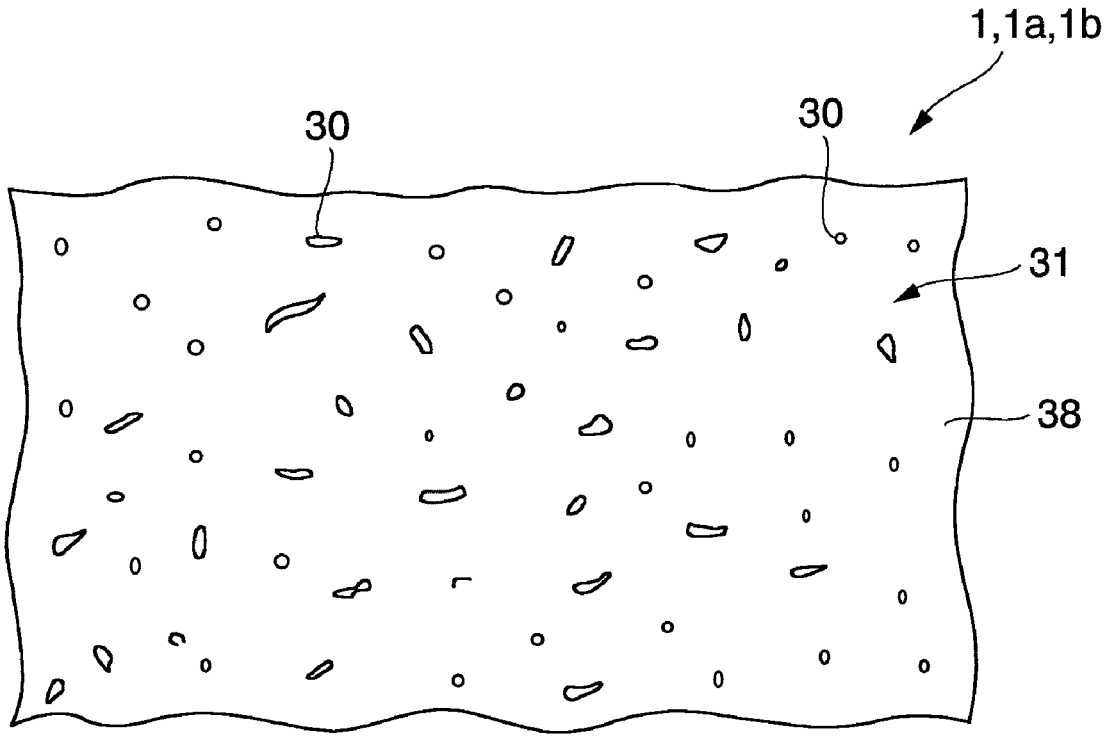

FIG. 4 is a cross-sectional view of a belt 1 according to a first embodiment of the present invention. FIG. 5 is a cross-sectional view of a wet paper web transfer belt 1*a* (hereinafter referred to as "belt 1*a*") according to a second embodiment of the present invention, and FIG. 5 corresponds to FIG. 4. FIG. 6 is a cross-sectional view of a wet paper web transfer belt 1*b* (hereinafter referred to as "belt 1*b*") according to a third embodiment of the present invention, and FIG. 6 corresponds to FIG. 4. FIG. 7 is a plan view of the belts 1, 1*a* and 1*b*.

In FIGS. 1 through 7, the belts 1, 1*a* and 1*b* have a widthwise dimension D in a predetermined widthwise direction (CMD direction), and travel in a warpwise direction (MD direction) with the wet paper web W placed on an upper surface of the belts. Therefore, the belts 1, 1*a* and 1*b* are always subject to a tension which tends to pull them in the traveling direction (MD direction).

The belts 1, 1*a* and 1*b* have a wet paper web-side layer 31, including a resin and a hydrophilic fibrous body 30 and disposed on the wet paper web W side, and a machine-side layer 32 disposed on the press roll 10 side. The belts 1, 1*a* and 1*b* include respective base fabrics 33, 33*a* and 33*b* disposed therein. The belts 1, 1*a* and 1*b* are of a laminar structure in their entirety with the wet paper web-side layer 31 and the machine-side layer 32 disposed one on each side of the substrates 33, 33*a* and 33*b*.

The hydrophilic property of the hydrophilic fibrous body 30 refers to a property to attract water and/or a property to retain water. According to the present invention, the hydrophilic property is represented by "official moisture regain" specified in JIS L0105 (general principles of physical testing methods for textiles).

The base fabrics 33, 33*a* and 33*b* which are of a laminated structure are constructed of a first woven fabric 34 disposed as an upper fabric on the wet paper web W side and a second woven fabric 35 disposed as a lower fabric on the press roll 10 side, and the first woven fabric 34 and the second woven fabric 35 are stacked together. At least a portion of the hydrophilic fibrous body 30 is exposed on a surface 37 of the wet paper web-side layer 31.

The term "exposed" refers to a state in which the hydrophilic fibrous body 30 appears on the surface 37 of the wet paper web-side layer 31, irrespectively of whether the hydrophilic fibrous body 30 projects outwardly from the surface 37 of the wet paper web-side layer or not. FIG. 7 shows an example of the state in which the hydrophilic fibrous body 30 is exposed on the surface 37 of the wet paper web-side layer 31, though the invention should not be limited to the illustrated state.

In order to improve the first function to positively cause the wet paper web W to stick on the surface of the belts 1, 1*a* and 1*b* and transfer the wet paper web W and to improve the second function to allow the wet paper web W to be smoothly released from the belts 1, 1*a* and 1*b* for transferring the wet paper web W to a next process, the hydrophilic fibrous body 30 is formed in the wet paper web-side layer 31 of the belts 1, 1*a* and 1*b* by needle punching.

In the base fabrics 33, 33*a* and 33*b* which are of a laminated structure, the first woven fabric 34 disposed on the wet paper web W side has a basis weight which is greater than the basis weight of the second woven fabric 35 disposed on the press roll 10 side.

The first woven fabric 34 and the second woven fabric 35 are stacked together so that the base fabrics 33, 33*a* and 33*b* are formed. The vertical positions of the center G of gravity of the base fabrics 33, 33*a* and 33*b* themselves of the belts 1, 1*a* and 1*b* are thus shifted toward the first woven fabric 34 closely to the wet paper web W.

For example, the dimension L1 from the position of the center G of gravity of the base fabrics 33, 33*a* and 33*b* of the belts 1, 1*a* and 1*b* to the upper surface of the first woven fabric 34 is smaller than the dimension L2 from the position of the center G of gravity to the lower surface of the second woven fabric 35.

While the belts 1, 1*a* and 1*b* are traveling, the belts 1, 1*a* and 1*b* are subject to a tension to pull them in the traveling direction (MD direction). Most of the tension acts on the base fabrics 33, 33*a* and 33*b* which make the belts 1, 1*a* and 1*b* strong.

The tension acting on the base fabrics 33, 33*a* and 33*b* is displaced from the central position of the base fabrics toward the wet paper web W side. Therefore, the belts 1, 1*a* and 1*b* are subject to a force tending to bring their opposite edges E, i.e., left and right edges spaced transversely across the traveling direction of the belts (MD direction), and nearby portions closely to the wet paper web W.

The wet paper web-side layer 31 of the belts 1, 1*a* and 1*b* comprises a resin layer containing a resin such as a high-polymer elastic material 39. Consequently, the belts 1, 1*a* and 1*b* have an innate property to curl opposite edges E of the belts in a direction away from the wet paper web W irrespective of whether the belts are traveling or not.

Therefore, when the belts 1, 1*a* and 1*b* travel, their innate property to curl the opposite edges E thereof in a direction away from the wet paper web W and the action to curl the opposite edges E and nearby portions of the belts 1, 1*a* and 1*b* in a direction toward the wet paper web W under tension offset (cancel) each other. As a consequence, any curling of the opposite edges E and nearby portions of the belts 1, 1*a* and 1*b* is minimized while the belts 1, 1*a* and 1*b* are traveling.

In FIG. 2, the hatched areas represent ranges wherein the opposite edges and near portions of the wet paper web transfer belt according to the background art are curled while it is traveling. The belts 1, 1*a* and 1*b* according to the present invention cause no curling in the illustrated hatched areas (the opposite edges and near portions of the belt).

The belts 1, 1*a* and 1*b* tend to have the widthwise dimension D increased due to the absorption of water by the hydrophilic fibrous body 30. Either one or both of the first woven fabric 34 and the second woven fabric 35 include weft yarns 36 made of a material of low water absorptivity. As a result, the belts 1, 1*a* and 1*b* are capable of reducing an increase in the widthwise dimension D of the belts.

The wet paper web-side layer 31 includes a wet paper web-side batt layer 38 made up of the hydrophilic fibrous body 30. Therefore, the wet paper web-side batt layer 38 is of high water absorbability. The wet paper web-side batt layer 38 is impregnated with a high-polymer elastic material 39, making the portion of the hydrophilic fibrous body 30 exposed on the surface 37 of the wet paper web-side layer 31.

The high-polymer elastic material 39 may be made of a thermosetting resin such as urethane, epoxy, acrylic, or the like or a thermoplastic resin such as polyamide, polyarylate, polyester, or the like. As described above, the wet paper web-side layer 31 comprises the resin layer containing the high-polymer elastic material 39.

The belts 1, 1*a* and 1*b* should preferably be impermeable to air. However, depending on the papermaking machine 2, the belts 1, 1*a* and 1*b* may slightly be permeable to air. The belts 1, 1*a* and 1*b* may have desired air permeability if the amount of the impregnated high-polymer elastic material 39 is reduced, the surface 37 of the wet paper web-side layer 31 is polished, or the high-polymer elastic material contains interconnected pores.

The wet paper web-side batt layer 38 of the wet paper web-side layer 31 and a machine-side batt layer 40 of the machine-side layer 32 are made of staple fibers. The hydrophilic fibrous body 30 is used as the staple fibers of the wet paper web-side batt layer 38. Fibers which have lower official moisture regain than the hydrophilic fibrous body 30 are used as the staple fibers of the machine-side batt layer 40.

The wet paper web-side batt layer 38 is intertwiningly integrated with the wet paper web side of the base fabrics 33, 33*a* and 33*b* by needle punching. The machine-side batt layer 40 is intertwiningly integrated with the machine side (press roll 10 side) of the base fabrics 33, 33*a* and 33*b*. A means for integrating the wet paper web-side batt layer 38 and a means for integrating the machine-side batt layer 40 may be adhesive bonding, electrostatic flocking, or the like as well as needle punching.

The hydrophilic fibrous body 30 should preferably have an official moisture regain of 4% or higher. Specifically, the fibers of the hydrophilic fibrous body 30 are selected from the group consisting of hydrophilic fibers made of nylon (official moisture regain of 4.5%), vinylon (official moisture regain of 5.0%), acetate (official moisture regain of 6.5%), rayon (official moisture regain of 11.0%), polynosic rayon (official moisture regain of 11.0%), cuprammonium rayon (official moisture regain of 11.0%), cotton (official moisture regain of 8.5%), hemp (official moisture regain of 12.0%), silk (official moisture regain of 12.0%) and wool (official moisture regain of 15.0%), etc. The numerical values in the parentheses represent official moisture regains.

If fibers having an official moisture regain of less than 4% are used, then since they cannot sufficiently retain the water from the wet paper web W, they fail to sufficiently perform the first function to cause the wet paper web W to stick on the belts 1, 1*a* and 1*b* and to transfer the wet paper web W.

According to inventive examples and comparative examples to be described later, the wet paper web-side batt layer 38 and the machine-side batt layer 40 are made of rayon fibers or nylon fibers.

The hydrophilic fibrous body 30 may be made of fibers having surfaces which are chemically hydrophilic. Specifically, the surfaces of the fibers may be treated by a mercerizing process, a resinating process, a sputtering process based on the application of an ionizing radiation, a glow discharge process, or the like.

The hydrophilic process can exhibit good results if the contact angle with water is 30 degrees or less while the moisture of hydrophilic monofilaments or twist yarns is adjusted to a value in the range from 30 to 50%. The percentage of the moisture of the monofilaments or twist yarns is calculated by the equation:

$$(\text{water}/\text{overall weight})\times 100$$

After the wet paper web-side batt layer 38 is impregnated with the high-polymer elastic material 39 and is cured, the surface of the wet paper web-side batt layer 38 is ground by sandpaper or a grinding stone. To prevent the fibers of the hydrophilic fibrous body 30 from being fibrilized when the surface of the wet paper web-side batt layer 38 is ground, it is desirable for the hydrophilic fibrous body 30 to have a strength of 0.8 g/dtex or higher.

As a result, at least the portion of the hydrophilic fibrous body 30 is exposed on the surface 37 of the wet paper web-side layer 31. Consequently, when the belts 1, 1*a* and 1*b* transfer the wet paper web W to a next process, the belts 1, 1*a* and 1*b* perform the second function to smoothly release the wet paper web W therefrom.

The machine-side batt layer 40 comprises a fibrous body 41 made of fibers which are less hydrophilic, or of a lower official moisture regain, than the hydrophilic fibrous body 30 of the wet paper web-side batt layer 38. Specifically, the fibrous body 41 may be made of fibers whose official moisture regain is different from the official moisture regain of the hydrophilic fibrous body 30 by 4% or more.

Alternatively, the fibers of the fibrous body 41 may be selected from the group consisting of fibers made of vinylidene (official moisture regain of 0%), polyvinyl chloride (official moisture regain of 0%), polyethylene (official moisture regain of 0%), polypropylene (official moisture regain of 0%), polyester (official moisture regain of 0.4%), aromatic polyamide (official moisture regain of 0.4%), polyurethane (official moisture regain of 1.0%) and acrylic (official moisture regain of 2.0%), etc. which are of low official moisture regains.

Since the machine-side batt layer 40 is held in contact with the press roll 10, the machine-side batt layer 40 may be made chiefly of nylon fibers, which are of excellent wear resistance, and other fibers mixed therewith.

The wet paper web-side batt layer 38 of the wet paper web-side layer 31 should preferably have a basis weight in the range from 50 to 600 g/m$^2$. The machine-side batt layer 40 of the machine-side layer 32 should preferably have a basis weight in the range from 0 to 600 g/m$^2$.

The base fabrics 33, 33*a* and 33*b* comprise the first woven fabric 34 and the second woven fabric 35 which are stacked together. The first woven fabric 34 and the second woven fabric 35 are produced by weaving warp yarns 42 in the MD direction and the weft yarns 36 in the CMD direction.

The weft yarns 36 of either one or both of the first woven fabric 34 and the second woven fabric 35 are made of a material selected from the group consisting of polyester, aromatic polyamide, aromatic polyester and polyether ketone which are of low water absorbability.

With the weft yarns 36 being made of such a material, it is possible to reduce an increase in the widthwise dimension D of the belt due to the absorption of water by the hydrophilic fibrous body 30 of the wet paper web-side batt layer 38.

The first woven fabric 34 and the second woven fabric 35 have a structure which is either one of a plain weave, a double weave and a triple weave, as described below. The basis weight of the first woven fabric 34 is greater than the basis weight of the second woven fabric 35.

The belts 1, 1*a* and 1*b* are manufactured by a needle machine. The first woven fabric 34 and the second woven fabric 35 are stacked together into the base fabrics 33, 33*a* and 33*b*. Then, while the base fabrics 33, 33*a* and 33*b* which are of the stacked-layer structure are being transported along guide rolls of the needle machine, the wet paper web-side batt layer 38 is needle-punched. At this time, since the lower fabric (the second woven fabric 35) of the base fabric is held in contact with the guide rolls, the upper fabric (the first woven fabric 34) of the base fabric needs to be elongated to match an increase in the dimension of the lower fabric.

Inasmuch as the basis weight of the upper fabric (the first woven fabric 34) is greater than the basis weight of the lower fabric (the second woven fabric 35), the lower fabric with the lower basis weight is more liable to elongate than the upper fabric. As a consequence, when the wet paper web-side batt layer 38 is needle-punched, the lower fabric is liable to slack. If the slacked lower fabric contacts the guide rolls of the needle machine, the lower fabric tends to wrinkle under the pressing force from the guide rolls.

According to the present invention, after the upper fabric (the first woven fabric 34) is placed in the needle machine, the lower fabric (the second woven fabric 35) is stacked on the upper fabric, producing the base fabrics 33, 33*a* and 33*b*, and then the machine-side batt layer 40 is needle-punched over the lower fabric (the second woven fabric 35).

Then, the stacked base fabrics 33, 33*a* and 33*b* are turned upside down, and the wet paper web-side batt layer 38 is needle-punched over the upper fabric (the first woven fabric 34).

In this manner, the lower fabric with the smaller basis weight is prevented from wrinkling. In addition, the warpwise dimensions of the upper fabric and the lower fabric (the first woven fabric 34 and the second woven fabric 35) can be brought into conformity with each other.

Since such a "dimensional match" can be achieved by the present invention, it is possible to produce the base fabrics 33, 33*a* and 33*b* which have a good structure wherein the first woven fabric 34 and the second woven fabric 35 are free of warpwise positional displacements.

For making the basis weight of the first woven fabric 34 greater than the basis weight of the second woven fabric 35 in the base fabric, the base fabric 33 (FIG. 4) according to one case includes the upper fabric (the first woven fabric 34) which is of a double weave and the lower fabric (the second woven fabric 35) which is of a plain weave.

According to another case, the base fabric 33*a* (FIG. 5) includes the upper fabric (the first woven fabric 34) which is of a triple weave and the lower fabric (the second woven fabric 35) which is of a double weave.

According to still another case, the base fabric 33*b* (FIG. 6) includes the upper fabric (the first woven fabric 34) which is of a triple weave and the lower fabric (the second woven fabric 35) which is of a plain weave.

EXAMPLES

Figure 8:
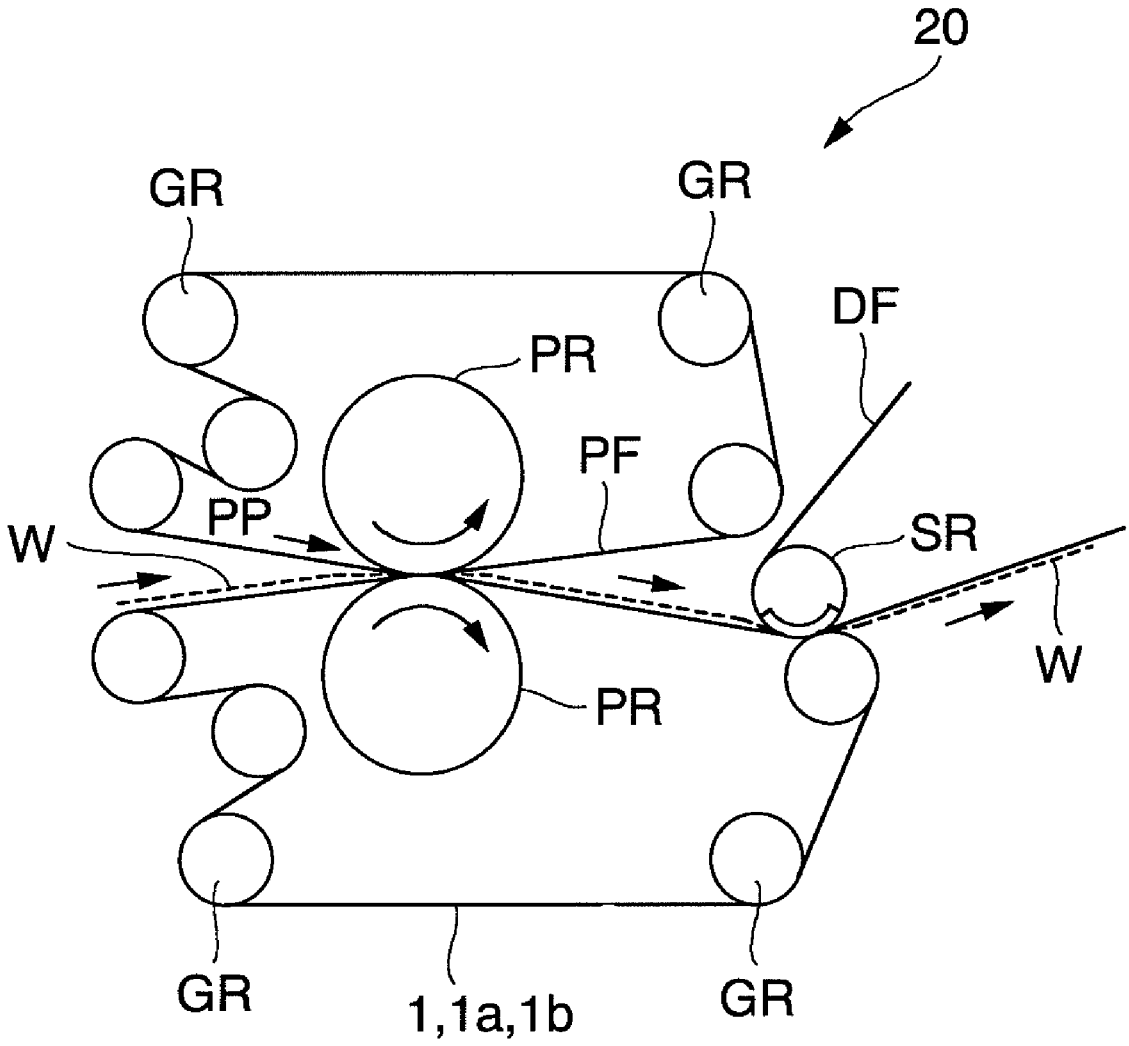

Experiments were conducted on specific inventive examples 1 through 3 and comparative examples 1 through 6 by an experimental apparatus 20. FIG. 8 is a schematic view of the experimental apparatus 20 for evaluating the performance of wet paper web transfer belts.

The experimental apparatus 20 comprises a pair of press rolls PR, PR providing a press region PP, a press felt PF pinched between the press rolls PR, PR, and a belt (belt1, 1*a* or 1*b*).

The press felt PF and the belt 1, 1*a* and 1*b* are supported under constant tension by a plurality of guide rollers GR. The press felt PF and the belt 1, 1*a* and 1*b* are driven to travel as the press rolls PR rotate. A drier fabric DF is of an endless structure as with the press felt PF and the belt 1, 1*a* and 1*b*, and travels while being supported by guide rollers.

In the experimental apparatus 20, a wet paper web W is placed on the belt 1, 1*a* and 1*b* which is positioned upstream of the press region PP. The wet paper web W is transported by the belt 1, 1*a* and 1*b* to pass through the press region PP, and thereafter reaches a suction roll SR. The wet paper web W is attracted by the suction roll SR and is transferred to the drier fabric DF.

In the experimental apparatus 20, the belt 1, 1*a* and 1*b* travels in the MD direction at a speed of 2,000 m/min in view of the high-speed operation of the closed-draw-type papermaking machines.

In the experimental apparatus 20, the widthwise dimension D in the CMD direction of the belt 1, 1*a* and 1*b* is greater than the widthwise dimension of the press region PP and the guide roller GR. The opposite edges E and nearby portions of the belt 1, 1*a* and 1*b* can be observed for curling, i.e., whether curling has occurred or not and the state of curling, if any, from a position upstream of the press region PP of the experimental apparatus 20.

Details of the Base Fabrics 33, 33*a* and 33*b*:

(A) Structure and Basis Weight:

1. Plain weave . . . basis weight 100 through 400 (g/m$^2$)
2. Double weave . . . basis weight 400 through 700 (g/m$^2$)
3. Triple weave . . . basis weight 500 through 900 (g/m$^2$)

(B) Yarn Material (Warp Yarns 42 and Weft Yarns 36)

1. Monofilament and multifilament
2. Monofilament twist yarn
3. Multifilament twist yarn
4. Monofilament and multifilament combined twist yarn (C) Material of Yarns (Warp Yarns 42 and Weft Yarns 36)

1. Nylon
2. Polyester (particularly, polyethylene terephthalate (PET)
3. Aromatic polyamide
4. Aromatic polyester
5. Polyether ketone (D) Stacked-Layer Structure of Base Fabrics (Upper Fabric/Lower Fabric)

1. Double weave/plain weave . . . (see FIG. 4)
2. Triple weave/double weave . . . (see FIG. 5)
3. Triple weave/plain weave . . . (see FIG. 6)

In these base fabrics, the basis weight of the upper fabric is greater than the basis weight of the lower fabric.

Inventive Example 1

1. Base Fabric 33

The upper fabric (the first woven fabric 34) was of a warp double weave structure (the warp yarns 42 comprised nylon monofilament twist yarns and the weft yarns 36 comprised nylon monofilament twist yarns), and had a basis weight of 400 g/m$^2$.

The lower fabric (the second woven fabric 35) was of a 1/1 plain weave structure (the warp yarns 42 comprised nylon multifilament twist yarns and the weft yarns 36 comprised PET single yarns), and had a basis weight of 200 g/m$^2$.

2. Batt Layer

The wet paper web-side batt layer 38 was formed of rayon fibers of the hydrophilic fibrous body 30 by needle punching, and had a basis weight of 600 g/m$^2$. The machine-side batt layer 40 was formed of nylon fibers by needle punching, and had a basis weight of 250 g/m$^2$.

3. Impregnation of High-Polymer Elastic Material 39

The wet paper web batt layer of the needle-punched felt was impregnated with a urethane resin at a rate of 500 g/m$^2$.

4. An Experiment Conducted by the Experimental Apparatus 20

The dimensions (in the traveling direction and the widthwise direction) of the wet paper web transfer belt immediately after the experiment started were indicated by 100, and the belt dimensions were measured after 100 hours from the experimentation to evaluate changes in the belt dimensions.

Dimensional changes after the experiment: Traveling direction (elongated 1.2%), widthwise direction (elongated 1.0%)

Whether curling occurred in the opposite edges E and nearby portion of the belt: No curling occurred.

Inventive Example 2

1. Base Fabric 33*a*

The upper fabric (the first woven fabric 34) was of a warp triple weave structure (the warp yarns comprised nylon monofilament twist yarns and the weft yarns comprised PET single yarns), and had a basis weight of 600 g/m$^2$.

The lower fabric (the second woven fabric 35) was of a warp double weave structure (the warp yarns comprised nylon monofilament twist yarns and the weft yarns comprised nylon single yarns), and had a basis weight of 400 g/m$^2$.

2. Batt Layer

Same as inventive example 1.

3. Impregnation of High-Polymer Elastic Material 39

Same as inventive example 1

4. An Experiment Conducted by the Experimental Apparatus 20

Dimensional changes after the experiment: Traveling direction (elongated 1.2%), widthwise direction (elongated 0.6%)

Whether curling occurred in the opposite edges E and nearby portion of the belt: No curling occurred.

Inventive Example 3

1. Base Fabric 33*b*

The upper fabric (the first woven fabric 34) was of a warp triple weave structure (the warp yarns comprised nylon monofilament twist yarns and the weft yarns comprised PET single yarns), and had a basis weight of 600 g/m$^2$.

The lower fabric (the second woven fabric 35) was of a 1/1 plain weave structure (the warp yarns comprised nylon multifilament twist yarns and the weft yarns comprised PET single yarns), and had a basis weight of 200 g/m$^2$.

2. Batt Layer

Same as inventive example 1.

3. Impregnation of High-Polymer Elastic Material 39

Same as inventive example 1.

4. An Experiment Conducted by the Experimental Apparatus 20

Dimensional changes after the experiment: Traveling direction (elongated 1.2%), widthwise direction (elongated 0.4%)

Whether curling occurred in the opposite edges E and nearby portion of the belt: No curling occurred.

Comparative Example 1

1. Base Fabric

The upper fabric (the wet paper web-side woven fabric) was of a warp double weave structure (the warp yarns comprised nylon monofilament twist yarns and the weft yarns comprised nylon monofilament twist yarns), and had a basis weight of 400 g/m$^2$.

The lower fabric (the press roll-side woven fabric) was of a 1/1 plain weave structure (the warp yarns comprised nylon multifilament twist yarns and the weft yarns comprised nylon single yarns), and had a basis weight of 200 g/m$^2$.

2. Batt Layer

Same as inventive example 1.

3. Impregnation of High-Polymer Elastic Material

Same as inventive example 1.

4. An Experiment Conducted by the Experimental Apparatus 20

Dimensional changes after the experiment: Traveling direction (elongated 1.2%), widthwise direction (elongated 2.0%)

Whether curling occurred in the opposite edges E and nearby portion of the belt: No curling occurred.

Comparative Example 2

1. Base Fabric

The upper fabric (the wet paper web-side woven fabric) was of a warp triple weave structure (the warp yarns comprised nylon monofilament twist yarns and the weft yarns comprised nylon monofilament twist yarns), and had a basis weight of 600 g/m$^2$.

No lower fabric was used.

2. Batt Layer

Same as inventive example 1.

3. Impregnation of High-Polymer Elastic Material

Same as inventive example 1.

4. An Experiment Conducted by the Experimental Apparatus 20

Dimensional changes after the experiment: Traveling direction (elongated 1.2%), widthwise direction (elongated 2.5%)

Whether curling occurred in the opposite edges E and nearby portion of the belt: No curling occurred.

Comparative Example 3

1. Base Fabric

The upper fabric (the wet paper web-side woven fabric) was of a warp double weave structure (the warp yarns comprised nylon monofilament twist yarns and the weft yarns comprised nylon monofilament twist yarns), and had a basis weight of 400 g/m$^2$.

The lower fabric (the press roll-side woven fabric) was of a 1/1 plain weave structure (the warp yarns comprised nylon multifilament twist yarns and the weft yarns comprised nylon single yarns), and had a basis weight of 200 g/m$^2$.

2. Batt Layer

The wet paper web-side batt layer was formed of nylon fibers by needle punching, and had a basis weight of 600 g/m$^2$. The roll-side batt layer was formed of nylon fibers by needle punching, and had a basis weight of 250 g/m$^2$.

3. Impregnation of High-Polymer Elastic Material

Same as inventive example 1.

4. An Experiment Conducted by the Experimental Apparatus 20

Dimensional changes after the experiment: Traveling direction (elongated 1.0%), widthwise direction (elongated 0.5%)

Whether curling occurred in the opposite edges E and nearby portion of the belt: No curling occurred.

Comparative Example 4

1. Base Fabric

The upper fabric (the wet paper web-side woven fabric) was of a 1/1 plain weave structure (the warp yarns comprised nylon multifilament twist yarns and the weft yarns comprised PET single yarns), and had a basis weight of 200 g/m$^2$.

The lower fabric (the press roll-side woven fabric) was of a warp double weave structure (the warp yarns comprised nylon monofilament twist yarns and the weft yarns comprised nylon monofilament twist yarns), and had a basis weight of 400 g/m$^2$.

2. Batt Layer

Same as inventive example 1.

3. Impregnation of High-Polymer Elastic Material

Same as inventive example 1.

4. An Experiment Conducted by the Experimental Apparatus 20

Dimensional changes after the experiment: Traveling direction (elongated 1.2%), widthwise direction (elongated 1.0%)

Whether curling occurred in the opposite edges E and nearby portion of the belt: Occurrence of curling was confirmed.

Comparative Example 5

1. Base fabric

The upper fabric (the wet paper web-side woven fabric) was of a warp double weave structure (the warp yarns comprised nylon monofilament twist yarns and the weft yarns comprised nylon single yarns), and had a basis weight of 400 g/m$^2$.

The lower fabric (the press roll-side woven fabric) was of a warp triple weave structure (the warp yarns comprised nylon monofilament twist yarns and the weft yarns comprised PET single yarns), and had a basis weight of 600 g/m$^2$.

2. Batt Layer

Same as inventive example 1.

3. Impregnation of High-Polymer Elastic Material

Same as inventive example 1.

4. An Experiment Conducted by the Experimental Apparatus 20

Dimensional changes after the experiment: Traveling direction (elongated 1.2%), widthwise direction (elongated 0.6%)

Whether curling occurred in the opposite edges E and nearby portion of the belt: Occurrence of curling was confirmed.

Comparative Example 6

1. Base Fabric

The upper fabric (the wet paper web-side woven fabric) was of a 1/1 plain weave structure (the warp yarns comprised nylon multifilament twist yarns and the weft yarns comprised PET single yarns), and had a basis weight of 200 g/m$^2$.

The lower fabric (the press roll-side woven fabric) was of a warp triple weave structure (the warp yarns comprised nylon monofilament twist yarns and the weft yarns comprised PET single yarns), and had a basis weight of 600 g/m$^2$.

2. Batt Layer

Same as inventive example 1.

3. Impregnation of High-Polymer Elastic Material

Same as inventive example 1.

4. An Experiment Conducted by the Experimental Apparatus 20

Dimensional changes after the experiment: Traveling direction (elongated 1.2%), widthwise direction (elongated 0.4%)

Whether curling occurred in the opposite edges E and nearby portion of the belt: Curling was prominent, and no adjustments could be made to cause the belt to travel at a speed of 2,000 m/min.

In the experiments using the experimental apparatus 20, the belts 1, 1*a* and 1*b* incorporating the base fabrics 33, 33*a* and 33*b* according to inventive examples 1 through 3 are capable of reducing increases in the widthwise dimension D thereof due to the absorption of water by the hydrophilic fibrous body, even with rayon fibers of the hydrophilic fibrous body included in the wet paper web-side batt layer, as compared with the wet paper web transfer belts according to comparative examples 1 through 3.

Specifically, the widthwise dimension D of the wet paper web transfer belts according to comparative examples 1 through 3 was increased by 0.5 to 2.5%. The widthwise dimension D of the belts 1, 1*a* and 1*b* was increased by 0.4 to 1.0%. It is thus understood that the increases in the widthwise dimension D of the belts 1, 1*a* and 1*b* are reduced.

It was found from the experimentation that the wet paper web transfer belt according to comparative example 3 had insufficient functions as a wet paper web transfer belt though it had good widthwise dimensional stability. Specifically, the first function to cause the wet paper web W to stick on the wet paper web transfer belt and to transfer the wet paper web W, and the second function to allow the wet paper web W to be smoothly released from the belt for transferring the wet paper web W to a next process were insufficient.

It was also found from the experimentation that the belts 1, 1*a* and 1*b* according to inventive examples 1 through 3 well performed the first function and the second function referred to above.

The wet paper web transfer belts according to comparative examples 4 through 6 had their opposite edges E and nearby portions curled because the lower fabric (the press roll-side woven fabric) was greater in basis weight than the upper fabric (the wet paper web-side woven fabric).

It was found from the experimentation that the belts 1, 1*a* and 1*b* according to inventive examples 1 through 3 were able to reduce curling of the opposite edges E and nearby portions thereof while they are running because the upper fabric (the first woven fabric 34) was greater in basis weight than the lower fabric (the second woven fabric 35).

In other words, it was found that the belts 1, 1*a* and 1*b* incorporating the base fabrics 33, 33*a* and 33*b* according to inventive examples 1 through 3 were able to significantly improve curling of the opposite edges E and nearby portions thereof while they are running, as compared with the wet paper web transfer belts according to comparative examples 4 through 6. As a result, the belts 1, 1*a* and 1*b* can travel at a high speed and highly stably.

The embodiments (including the inventive examples, the interpretation being also applicable wherever appropriate hereinafter) of the present invention have been described above. However, the present invention is not limited to the above embodiments, but various modifications and additions may be made within the scope of the present invention.

Identical reference characters denote identical or corresponding parts throughout views.

INDUSTRIAL APPLICABILITY

The wet paper web transfer belt according to the present invention is applicable to a belt for transferring a wet paper web in the press part of a closed-draw papermaking machine.

The invention claimed is:

1. A wet paper web transfer belt (1, 1*a*, 1*b*) for transferring a wet paper web (W) in a closed-draw papermaking machine (2), wherein said wet paper web transfer belt has a wet paper web-side layer (31), including a resin and a hydrophilic fibrous body (30) and disposed on a wet paper web (W) side, and a machine-side layer (32) disposed on a press roll (10) side, and a base fabric (33, 33*a*, 33*b*) is disposed in said belt, and wherein said base fabric (33, 33*a*, 33*b*) comprises a first woven fabric (34) disposed on the wet paper web (W) side and a second woven fabric (35) disposed on the press roll (10) side, and said first woven fabric (34) and said second woven fabric (35) are stacked together; and at least a portion of said hydrophilic fibrous body (30) is exposed on a surface (37) of said wet paper web-side layer (31), and the basis weight of said first woven fabric (34) is greater than the basis weight of said second woven fabric (35) and wherein the vertical position of the center (G) of gravity of said base fabric (33, 33*a*, 33*b*) itself is shifted to said first woven fabric (34).

2. A wet paper web transfer belt (1, 1*a*, 1*b*) according to claim 1, wherein either one or both of said first woven fabric (34) and said second woven fabric (35) include weft yarns (36) made of a material of low water absorptivity.

3. A wet paper web transfer belt (1, 1*a*, 1*b*) according to claim 2, wherein said weft yarns (36) of the woven fabrics (34, 35) are made of a material selected from the group consisting of polyester, aromatic polyamide, aromatic polyester and polyether ketone.

4. A wet paper web transfer belt (1) according to claim 1, 2 or 3, wherein said first woven fabric (34) is of a double weave and said second woven fabric (35) is of a plain weave.

5. A wet paper web transfer belt (1*a*) according to claim 1, 2 or 3, wherein said first woven fabric (34) is of a triple weave and said second woven fabric (35) is of a double weave.

6. A wet paper web transfer belt (1*b*) according to claim 1, 2 or 3, wherein said first woven fabric (34) is of a triple weave and said second woven fabric (35) is of a plain weave.

7. A wet paper web transfer belt (1, 1*a*, 1*b*) according to claim 1, 2 or 3, wherein said hydrophilic fibrous body (30) is formed in said wet paper web-side layer (31) of said belt (1, 1*a*, 1*b*) by needle punching to improve a first function, to cause said wet paper web (W) to stick thereon and to transfer said wet paper web (W), and a second function to allow said wet paper web (W) to be smoothly released therefrom for transferring the wet paper web (W) to a next process.

8. A wet paper web transfer belt (1, 1*a*, 1*b*) according to claim 1, 2 or 3, wherein said resin in said wet paper web-side layer (31) comprises a high-polymer elastic material (39), and said high-polymer elastic material (39) is made of a thermosetting resin selected from the group consisting of urethane, epoxy and acrylic, or of a thermoplastic resin selected from the group consisting of polyamide, polyarylate and polyester; and wherein said wet paper web-side layer (31) comprises a resin layer including said high-polymer elastic material (39).

9. A wet paper web transfer belt (1, 1*a*, 1*b*) according to claim 1, wherein the dimension (L1) from the position of the center (G) of gravity of said base fabric (33, 33*a*, 33*b*) to an upper surface of said first woven fabric (34) is smaller than the dimension (L2) from the position of the center (G) of gravity to a lower surface of said second woven fabric (35).

10. A wet paper web transfer belt (1, 1*a*, 1*b*) according to claim 1, wherein an innate property thereof to curl opposite edges (E) of the belt (1, 1*a*, 1*b*) in a direction away from said wet paper web (W) and an action thereof to curl the opposite edges (E) of the belt (1, 1*a*, 1*b*) in a direction toward said wet paper web (W) under tension cancel each other when the belt (1, 1*a*, 1*b*) travels.

11. A wet paper web transfer belt (1, 1*a*, 1*b*) according to claim 1, or 3, wherein said wet paper web-side layer (31) comprises a wet paper web-side batt layer (38) and said machine-side layer (32) comprises a machine-side batt layer (40), and each of said wet paper web-side batt layer (38) and said machine-side batt layer (40) is made of staple fibers;

wherein the hydrophilic fibrous body (30) is used as said staple fibers of said wet paper web-side batt layer (38); and wherein fibers having lower official moisture regain than said hydrophilic fibrous body (30) are used as said staple fibers of said machine-side batt layer (40).

12. A wet paper web transfer belt (1, 1*a*, 1*b*) according to claim 7, wherein said hydrophilic fibrous body (30) of said wet paper web-side layer (31) is made of fibers selected from the group consisting of hydrophilic fibers of nylon, vinylon, acetate, rayon, polynosic rayon, cuprammonium rayon, cotton, hemp, silk and wool for sufficiently performing the first function to cause the wet paper web (W) to stick on the wet paper web transfer belt (1, 1*a*, 1*b*) and to transfer the wet paper web (W).

13. A wet paper web transfer belt (1, 1*a*, 1*b*) according to claim 12, wherein said hydrophilic fibrous body (30) is made of fibers having surfaces which are processed by a hydrophilic process selected from the group consisting of a mercerizing process, a resinating process, a sputtering process based on the application of an ionizing radiation, and a glow discharge process.

14. A wet paper web transfer belt (1, 1*a*, 1*b*) according to claim 13, wherein said hydrophilic process is performed on the surfaces of the fibers of said hydrophilic fibrous body (30) at a contact angle of 30 degrees or less with water while the moisture of hydrophilic monofilaments or twist yarns is adjusted to a value in the range from 30 to 50%.

15. A wet paper web transfer belt (1, 1*a*, 1*b*) according to claim 11, wherein said machine-side batt layer (40) is made chiefly of nylon fibers for contact with the press roll (10), and said machine-side batt layer (40) comprises a fibrous body (41) made of fibers which are less hydrophilic than said hydrophilic fibrous body (30) of said wet paper web-side batt layer (38), and whose official moisture regain is different from the official moisture regain of said hydrophilic fibrous body (30) by 4% or more.

16. A wet paper web transfer belt (1, 1*a*, 1*b*) according to claim 15, wherein said fibrous body (41) of said machine-side batt layer (40) is made of fibers selected from the group consisting of fibers of vinylidene, polyvinyl chloride, polyethylene, polypropylene, polyester, aromatic polyamide, polyurethane and acrylic.

17. A wet paper web transfer belt (1, 1*a*, 1*b*) according to claim 11, wherein said wet paper web-side batt layer (38) of said wet paper web-side layer (31) has a basis weight set to a value ranging from 50 to 600 g/m$^2$, and said machine-side batt layer (40) of said machine-side layer (32) has a basis weight set to a value ranging from 0 to 600 g/m$^2$.

* * * * *